US005795236A

United States Patent [19]

Alberts et al.

[11] Patent Number: 5,795,236

[45] Date of Patent: Aug. 18, 1998

[54] REMOVABLE THUMB INSERT ASSEMBLY FOR BOWLING BALLS

[76] Inventors: Jack B. Alberts, 3000 Woodland Park Dr. #2107, Houston, Tex. 77082; Jeff A. Conley, 13111 Nantucket, Sugar Land, Tex. 77478

[21] Appl. No.: 771,950

[22] Filed: Dec. 23, 1996

[51] Int. Cl.[6] ..... A63B 37/00

[52] U.S. Cl. ..... 473/129; 473/130

[58] Field of Search ..... 473/127, 128, 473/129, 130

[56] References Cited

U.S. PATENT DOCUMENTS 2,435,327 2/1948 Seurynck ..... 273/63

2,436,976 3/1948 Seurynk ..... 273/63

3,001,793 9/1961 Insetta ..... 473/130

*Primary Examiner*—William M. Pierce

*Attorney, Agent, or Firm*—Ned L. Conley

[57] ABSTRACT

A removable bowling ball thumb insert sleeve for installation in a bowling ball hole, having an expander within a short counterbore in the bottom portion of the thumb insert sleeve. The expander device is actuated by rotation of an actuating screw using a tool inserted through a center bore within the thumb insert sleeve. Actuation of the expander device expands a split ring within the counterbore to engage the sleeve and urge it radially outwardly to engage the wall of the bowling ball hole and frictionally retain the sleeve within the hole.

3 Claims, 5 Drawing Sheets

REMOVABLE THUMB INSERT ASSEMBLY FOR BOWLING BALLS

FIELD OF THE INVENTION

This invention relates to improvements in bowling balls, and more specifically to a thumb grip insert removably mountable in a bowling ball to adapt it for use by an individual bowler.

BACKGROUND OF THE INVENTION

For many years, bowlers have used thumb inserts to improve ball gripping capability and comfort. These polymer based thumb inserts, installed in a hole drilled in the user's bowling ball, are commercially available in various material hardnesses and in round or contoured bores of various diameters.

On a seasonal, weekly and even daily basis, changes commonly occur in a bowling ball user's thumb diameter due to the bowler's body cycles. Similar variations will occur during a bowling series due to changes in temperature and humidity in a bowling alley or from thumb irritation due to contact and rubbing while bowling. These changes affect the user's thumb fit and prevent the consistent grip and release from the ball thumb hole required to accurately deliver the bowling ball. The recognition of this thumb fit problem has motivated many individuals to develop and patent configurations of thumb insert assemblies designed to allow a bowling ball user to expeditiously remove one thumb size insert and replace it with another thumb size insert.

Prior to 1994, because of restrictions imposed by the American Bowling Congress (ABC) who in concert with its affiliated organizations sanction essentially all amateur and professional bowling competitions, the bowling ball user had only two solutions to this problem for ABC sanctioned bowling activities. The first, and most expensive, of these solutions was for the user to own multiple bowling balls with different size thumb holes. The second, and more economical, solution was for the user to own a single ball possessing a thumb hole of maximum diameter needed to prevent thumb sticking under all potential conditions that, when required by thumb looseness, was reduced in effective size by the insertion of one or more strips of an adhesive tape.

In 1994 the ABC revised its rules to allow the use of mechanically retained and removable thumb inserts as long as such thumb inserts meet a specific set of design rules set forth by the ABC. In spite of this rule change and the approval by the ABC of four specific designs of such thumb insert assemblies there has to date been little wide use of such devices.

A review of several prior thumb insert designs indicates that their marketability is potentially compromised by a high installed cost for the thumb insert user. Replaceable thumb inserts are of benefit to the user only if he can possess multiple thumb insert sizes to suit his needs. Many of the replaceable thumb insert designs previously disclosed and patented contain complex parts that can only be produced using expensive machining procedures or costly injection molds that result in a high thumb insert cost. Alternatively, in other designs where the individual thumb insert is configurationally simple and can be manufactured at a low unit cost, the low insert cost is offset by the need for special features that must be machined in a bowling ball for thumb insert retention. Such machined features result in a high charge to the bowling ball purchaser to cover tooling costs and installation time.

Two such inserts are disclosed in U.S. Pat. Nos. 2,435,327 and 2,436,976. Those patents describe configurations of finger inserts for bowling balls that are intended to be frictionally retained within the bowling ball hole in which the insert is installed by engagement of the wall of the hole by radially expandable plungers in an assembly mechanically fastened to the bottom of an insert sleeve.

SUMMARY OF THE INVENTION

Accordingly, a main object of the invention is to provide a novel, improved means for overcoming the deficiencies and shortcomings of permanently installed bowling ball thumb inserts previously employed and the replaceable thumb insert designs currently disclosed.

Accordingly, an objective of the present invention is to provide inserts providing significant improvements over prior art finger inserts.

A further objective of the invention is to provide a novel and improved bowling ball hole thumb insert which is easy to install and remove, and which can be quickly and readily changed to enable a bowler to use a bowling ball with improved accuracy and comfort.

A still further objective of the invention is to provide a thumb insert which utilizes a single and quickly interchangeable actuating device that enables a bowler, at a minimum cost, to install, secure and substitute inserts from a set with varied hole sizes and/or shapes.

A still further objective of the invention is to provide a thumb insert which, on the occasion of its installation in a new undrilled bowling ball or a bowling ball possessing an existing thumb hole, requires no additional installation tools or procedures beyond those already utilized for the installation of the current permanently installed thumb inserts the invention is intended to replace.

A still further objective of the invention is to provide a thumb insert design which provides full interchangeability of inserts between multiple bowling balls with conventionally drilled thumb insert holes of equal diameter and depth.

A still further objective of the invention is to provide a thumb insert that, based upon the combination of an ergonomic factor described in this document and the force multiplying capability of the invention's mechanical design, insures safe frictional retention of the thumb insert within its accompanying bowling ball hole regardless of the level of strength of the bowling ball user.

A still further objective of the invention is to provide a thumb insert that by virtue of having full circumferential frictional contact between its frictional retaining surface and the bowling ball hole in which the thumb insert is installed provides a reliable and long wearing thumb insert retention capability.

A still further objective of the invention is to provide a thumb insert that possesses a retention strength that exceeds all rotational and extraction forces imposed upon said thumb insert during drilling and shaping of a thumb hole within said thumb insert.

A still further objective of the invention is to provide a thumb insert that within its design and materials meets all of the current restrictions and requirements of the American Bowling Congress for use in all events sanctioned by that organization and its affiliates.

A still further objective of the invention is to provide a thumb insert whose insert sleeve component can be manufactured and supplied as a functional equivalent of either current permanently installed thumb insert blank sleeves for custom thumb hole drilling and shaping or thumb inserts possessing a pre-sized and shaped thumb hole configured to any one of many hole sizes and shapes currently available to bowling ball users.

A still further objective of the invention is to provide a thumb insert possessing a safety feature whereby the component of the insert that provides the radial forces to frictionally retain the thumb insert in a bowling ball is isolated from all thumb extraction forces on the insert assembly, regardless of their magnitude, and therefore cannot be caused to fail due to these forces and result in a sudden release of the insert assembly from the ball in which it is being used.

BRIEF DESCRIPTION OF THE DRAWINGS

FIG. 9 is a vertical cross-sectional view, including a portion of a bowling ball, of a preshaped thumb insert consisting of the expander device shown in. FIG. 1 and the preshaped thumb insert sleeve shown in FIG. 6, which has previously had its upper edge contoured to the ball, inserted and locked in a bowling ball.

DESCRIPTION OF A PREFERRED EMBODIMENT OF THE INVENTION

Figure 1:
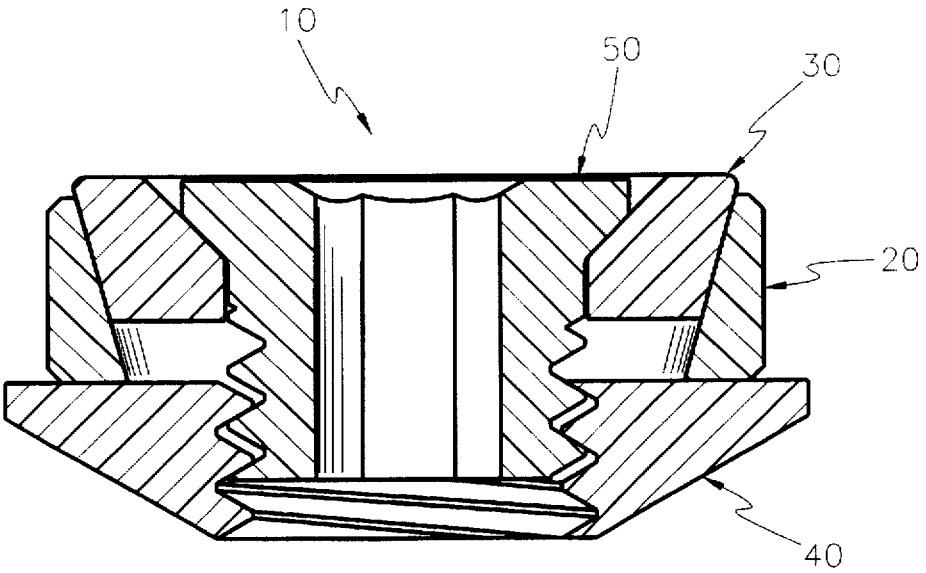
FIG. 1 is a vertical cross-sectional view of an isolated expander device assembly with its actuating screw and inner ring in their uppermost position and the outer ring at its unexpanded position.
Figure 3:
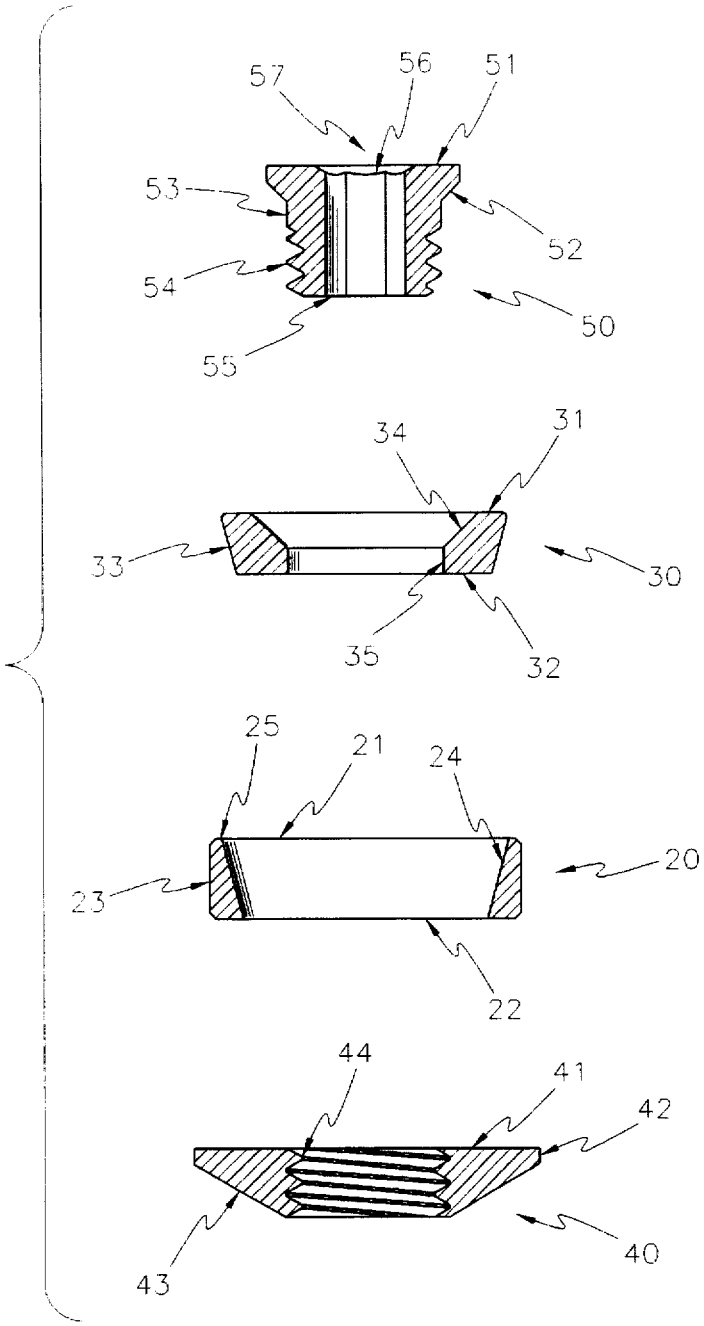
FIG. 3 is a vertically exploded view of the components of an expander device previously shown in FIG. 1 and FIG. 2.
Figure 8:
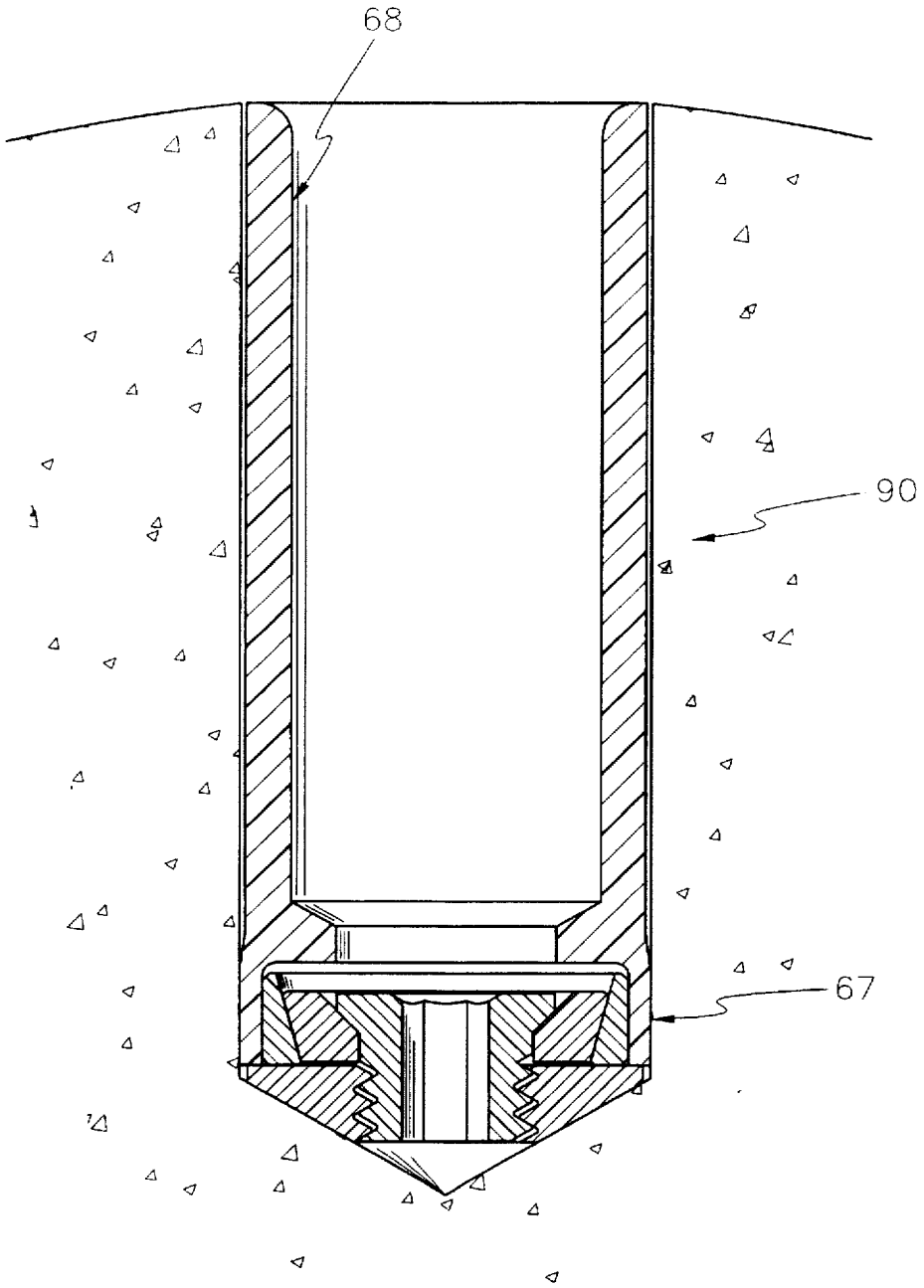
FIG. 8 is a vertical cross-sectional view, including a portion of a bowling ball, of a blank thumb insert consisting of the expander device shown in FIG. 1 and the blank insert sleeve shown in FIG. 5, following the drilling of said blank insert sleeve to a requested thumb hole diameter, the shaping of the top of the drilled insert sleeve to match the bowling ball's spherical surface and the radiusing of the top edge of the insert sleeve's thumb hole. For the purposes of clarity the bowling ball hole clearance and thumb insert sleeve expansion have been exaggerated to illustrate the principal and functional basis of the locking feature of the thumb insert.
Figure 9:
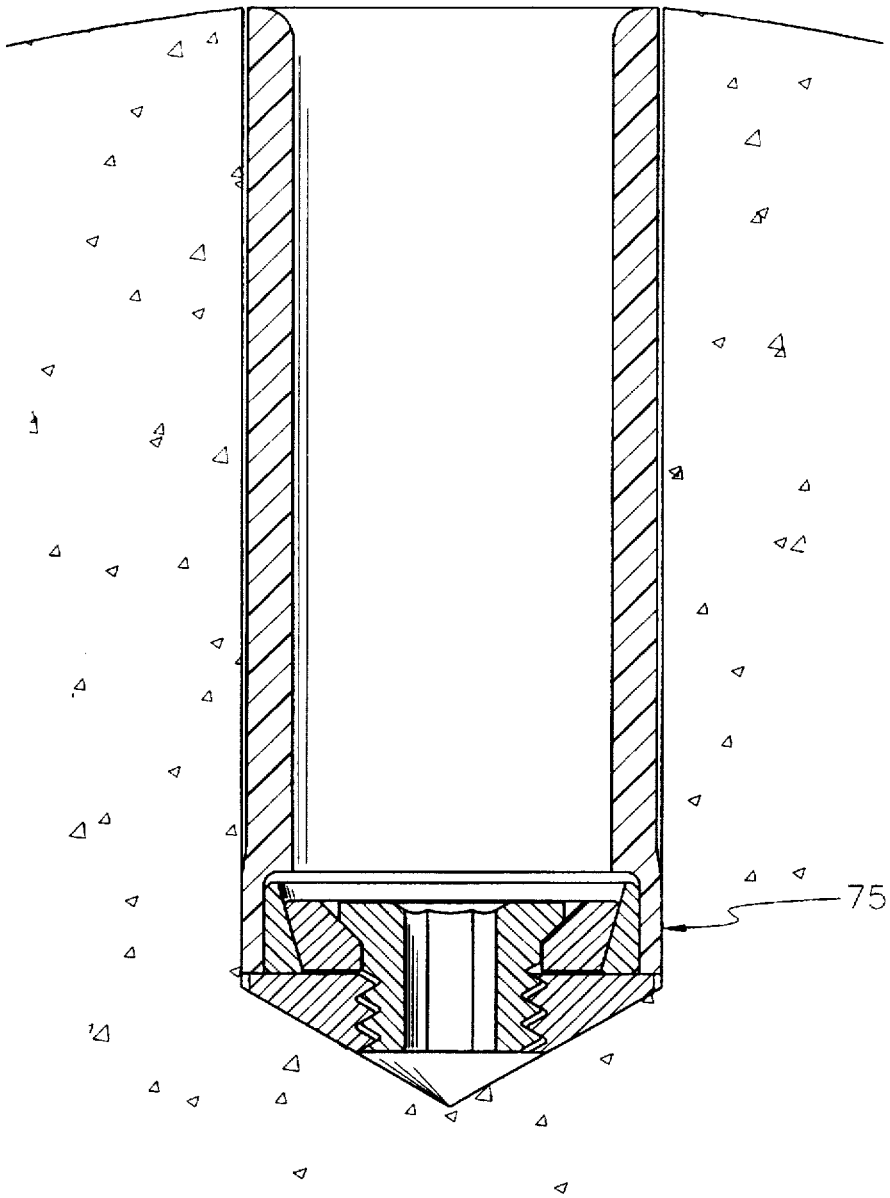

Referring to the drawings, FIG. 8 and FIG. 9 show two embodiments of completed thumb insert assemblies, installed and ready for bowling activities. The description is in terms of use of the invention for the thumb hole, although it should be understood that similar inserts appropriately sized for the purpose may also be employed in the finger holes. Thus, in FIGS. 1, 5 and 6, the three primary elements of an improved thumb hole insert according to the present invention are revealed. The first element, an expander device generally indicated as 10 in FIG. 1 is an assembly comprised of outer ring 20, inner ring 30, base disc 40 and actuating screw 50, illustrated individually in FIG. 3.

Figure 4:
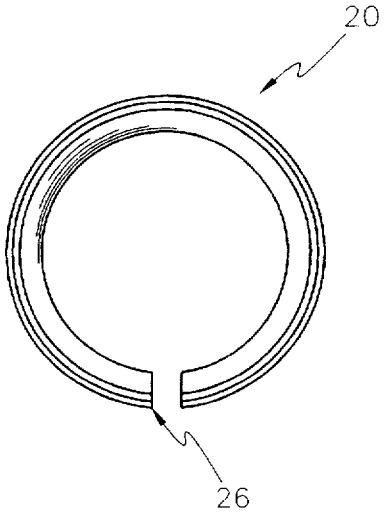
FIG. 4 is a top view of the outer ring of an expander device shown in FIG. 1.

In the embodiments described, outer ring 20 possesses a top face 21, a bottom face 22, a frustoconical throughbore 24 having its largest diameter 25 at top surface 21 and an outside right circular cylindrical surface 23. Outer ring 20 further possesses a single radial slot 26 extending from said ring's frustoconical throughbore 24 outwardly entirely through the wall of outer ring 20, as shown in FIG. 4.

Inner ring 30 has a flat top face 31, a flat bottom face 32 and an outside frustroconical surface 33 which initiates with its largest diameter at the top face 31 and tapers downwardly toward the bottom face 32 at an enclosed conical angle substantially equal to that of the frustroconical bore 24 in outer ring 20. Inner ring 30 also has a frustoconical bore 34, which initiates at top face 31, tapers downwardly, and terminates at an adjoined right circular cylindrical bore 35, which extends downwardly to bottom face 32.

Base disc 40 has a flat top face 41, an outer cylindrical surface 42 and a frustoconical bottom face 43. Said bottom face 43 preferably possesses an enclosed conical angle of approximately 118°. Base disc 40 also has a throughbore 44 threaded, preferably with a Unified National Coarse internal thread form, through its entire length. The overall height of base disc 40, as measured from top surface 41 to the adjoining edge of frustoconical bottom face 43 with throughbore 44, is preferably at least about one-half the pitch diameter of the thread.

Actuating screw 50 preferably has a top flat face 51 of a diameter at least about equal to the larger diameter of frustoconical bore 34 of inner ring 30. Said top face surface 51 is adjoined to a conical bottom head face 52 which possesses an enclosed conical taper approximately equal to and mating dependently with frustoconical bore 34. The taper of bore 34 acts as a stop for actuating screw 50, and may have any convenient included angle, preferably at least ninety degrees. Alternatively, a flat shouldered stop may be used. Conical bottom head face 52 tapers downwardly to adjoin a cylindrical screw shank 53 which possesses an external thread form 54 dependently matching the thread form in throughbore 44 of base disc 40. Actuating screw 50 also preferably possesses an uninterrupted hexagonal shaped throughbore 56 for its entire length. Actuating screw 50 further possesses an overall length preferably at least approximating the sum of combined heights of inner ring 30 and base disc 40.

The dimensioning of the parts just described will be apparent to one skilled in the art. Each part must be sized as necessary for it to accomplish its purpose in the assembly, as shown for example in FIG. 8. The dimensions of rings 20 and 30 should be selected for the two parts to mate together, so that the tapers substantially matching, and the height of inner ring 30 is somewhat greater than the height of outer ring 20 to provide for downward movement of ring 30 within ring 20 to engage the tapers and expand ring 20 sufficiently for it to bias outwardly the lower end of a sleeve 60 or 70 so that it grippingly engages the surrounding wall of the hole in the bowling ball. The frustoconical throughbore 24 and the mating surface 33 must be such as to allow sufficient radial expansion of ring 20. The length of threads 44 and 54 should provide for sufficient movement of the actuating screw 50 to sufficiently expand the ring 20. Ring 30 should not seat on base disc 40 before ring 20 is fully expanded. For the ring 30, a height of approximately one-quarter inch has been found to be satisfactory. Outer ring 20 has an outside diameter slightly larger than the counterbore 63 or 72 in the sleeve 60 or 70, to allow the expander device in its relaxed state to be frictionally held in the counterbore. The frustoconical throughbore 24 in ring 20 tapers downwardly at an enclosed conical angle suitable for providing an adequate mechanical advantage for the gripping engagement of the sleeve. An included angle of approximately fifteen degrees has been found to be satisfactory.

The selection of the materials of construction of the parts of the expander device 10 will also be apparent to those skilled in the art. To avoid undesired effect on the weight balance of the bowling ball, polymeric materials are preferred. The materials for elements 20, 30, 40 and 50 preferably are selected to facilitate sliding engagement between these elements, and should therefore provide for a coefficient of friction between these parts no greater than about 0.30. It has been found that Delrin acetal polymer is suitable for the outer ring 20, however, any polymer having a similar compressive strength and bending modulus would be acceptable for this component. For inner ring 30, Delrin A/F, an acetal polymer modified by the addition of Teflon to reduce its surface friction has been found satisfactory, but any polymer having minimum compressive strength of approximately ten thousand pounds per square inch and a similarly low friction coefficient value may be used. The material of construction of base disc 40 may be any polymer having minimum shear strength of at least about eight thousand pounds per square inch, such as Delrin acetal polymer. Delrin acetal polymer has also been found satisfactory for actuating screw 50, but any polymer having minimum tensile strength of approximately ten thousand pounds per square inch is acceptable. Instead of these Delrin polymers, various nylon compositions may be suitable.

Figure 5:
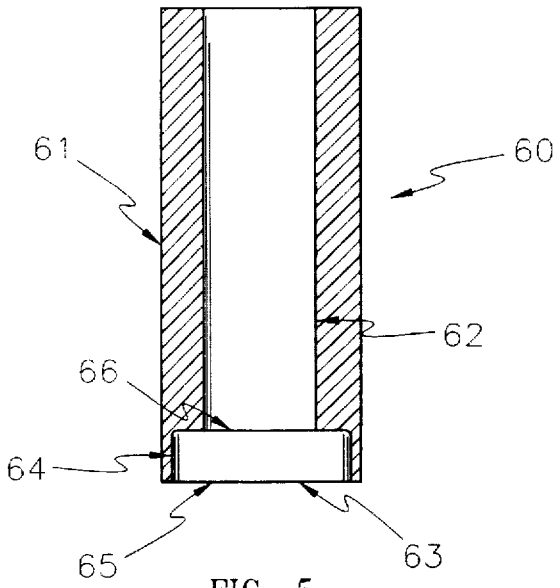
FIG. 5 is a vertical cross-sectional view of a thumb insert sleeve generally described as a blank thumb insert sleeve.
Figure 6:
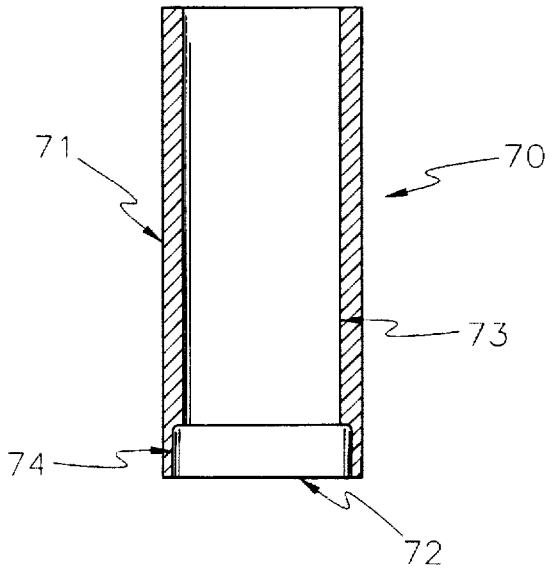
FIG. 6 is a vertical cross-sectional view of a thumb insert sleeve generally described as a presized or preshaped thumb insert sleeve.

Referring to FIGS. 5 and 6, there are disclosed two configurations of thumb insert sleeves for use with the disclosed expander device. Both configurations of said thumb insert sleeves are generally right circular cylindrical in shape with the outer cylindrical surface 61 of blank thumb insert sleeve 60, further described below, and outer cylindrical surface 71 of presized thumb insert sleeve 70, also further described below, both preferably possessing one of three outside cylindrical diameters which will provide a free sliding fit within the three standard drilled hole diameters, one and one-eighth inch, one and one quarter inch and one and three-eighths inch, i.e. approximately one and seven sixty-fourths inch, one and fifteen sixty-fourths inch or one and twenty-three sixty-fourth inch. The insert sleeves are preferably made of a material similar to the materials used for current permanently installed bowling ball thumb and finger inserts, which are well known to those skilled in the art. The material should have sufficient resilience to allow the lower end of the sleeve to be expanded, as hereinafter described.

Referring to FIG. 5, there is disclosed a thumb insert sleeve embodiment indicated as 60 that is generally described as a blank thumb insert sleeve. Said blank thumb insert sleeve 60 has a cylindrical throughbore 62, for the purpose of allowing the passage of the shank 81 of a screwdriver like actuating tool generally indicated as 80 in FIG. 7. Said throughbore 62 is preferably no larger than about one-half inch to permit drilling of thumb inserts for thumb diameters of as small as five-eighths inch. Said thumb insert sleeve 60 also possesses a bottom counterbore generally indicated as 63. Said counterbore consists of a cylindrical bore 64, having a diameter approximately equal to the relaxed diameter of outside surface 23 of outer ring 20, that extends upwardly from the bottom face 65 for a distance approximately equal to 1.25 times the height of outer ring 20, and terminates at upper flat counterbore face 66. The purpose of said counterbore 63 is to receive and retain the previously disclosed expander device 10 in a manner that allows said expander to secure thumb insert blank sleeve 60 in its surrounding bowling ball hole as described under the "Principal of Operation" and "Description of Installation and Operation" discussions included in this document.

Referring to FIG. 6, there is disclosed a second preferred thumb insert sleeve embodiment, generally indicated as 70, that is generally described as a preshaped thumb insert sleeve. Said preshaped thumb insert sleeve 70 possesses a bottom counterbore 72 that is dimensionally and functionally identical to bottom counterbore 63 in thumb insert sleeve 60. Preshaped thumb insert sleeve 70 is configured differently from blank thumb insert sleeve 60 only in that throughbore 73 of preshaped thumb insert sleeve 70 may possess any one or a combination of cylindrical, conical, oval or irregular thumb hole cross-sectional shapes and sizes, such as may be machined or molded into preshaped thumb insert sleeve 70 at the time of its manufacture.

FIG. 1 shows the assembly of expander device 10 with outer frustoconical surface 33 of inner ring 30 partially seated within the frustoconical bore 24 of outer ring 20 and with actuating screw 50 having the bottom frustoconical face 52 fully seated in the frustoconical surface 34 of the throughbore of inner ring 30. Further, the threaded portion 54 of actuating screw 50 is partially threadedly engaged with the threaded bore 44 of base disc 40. All aforementioned items are positioned in FIG. 1 such that outer ring 20 is in a relaxed, unexpanded position. The disclosed expander device 10 is further illustrated in FIG. 2 with outer ring 20 at its fully expanded diameter, as determined by outer frustoconical surface 33 of inner ring 30 being fully engaged within the frustoconical bore 24 of outer ring 20, and inner ring 30 being drawn to its maximum downward position as determined by the contact of bottom face 32 of inner ring 30 with top face 41 of base disc 40, such contact also defining the maximum threaded engagement of the thread 54 of actuating screw 50 with the threaded bore 44 of base disc 40.

The preferred materials of construction for both of the revealed thumb insert sleeves are either a polyvinylchoride or urethane polymer of a hardness of approximately 95A durometer with the selection between these two materials being dependent primarily on the method of manufacture, but any polymer material having a suitable resiliency and hardness and, in the case of the thumb insert blank sleeve 60, capable of being easily drilled and sanded to provide a smooth thumb hole bore and radiused top edge or, alternatively, in the case of preshaped thumb insert sleeve 70, capable of being molded to possess these features, may be used. The resiliency must be sufficient to allow the wall of the sleeve to be expanded to engage and tightly grip the wall of the surrounding bowling ball hole.

PRINCIPAL OF OPERATION

The disclosed expander device in its simplest description is a mechanism utilizing the combined mechanical advantage of the dependent engagement of thread 54 of actuating screw 50 with the threaded bore 44 of base disc 40, and the tapered angle sliding engagement between the frustoconical outer face 33 of inner ring 30 and frustoconical bore 24 of outer ring 20, to generate sufficient radial expansion and force on the inner cylindrical surface 64 of blank thumb insert sleeve 60 or corresponding inner cylindrical surface 74 of preshaped insert sleeve 70 in which the device is inserted, to: first, expand that portion of the wall of the said thumb insert sleeve to engage the corresponding outer surface of the sleeve with the adjacent wall of the hole in the bowling ball containing the thumb insert, and second, following such engagement, additionally apply significant radial contact force between the aforementioned thumb insert's outer surface and aforementioned hole's inner surface. The radial contact force must be sufficient for the frictional force resisting removal of the insert from the hole to exceed the force applied by a bowler's thumb while bowling which tends to pull the insert from the hole. It has been found that such a resistance is obtained if the coefficient of friction between the insert and the hole is at least 0.15. The extent of the maximum extraction force is, regardless of the weight of the bowling ball or the speed at which the ball is being swung, the maximum frictional force generated by the contact force between the bowling ball user's thumb back middle knuckle face and the ball of said thumb with the thumb insert's inside surface brought about by the bending of the user's thumb.

Figure 2:
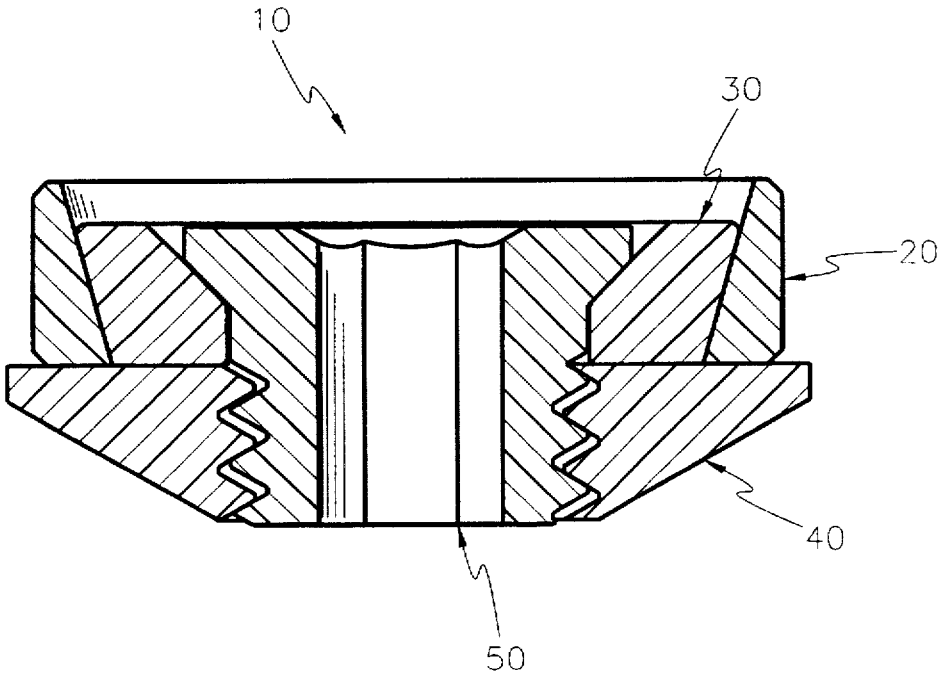
FIG. 2 is a vertical cross-sectional view of an isolated expander device assembly with its actuating screw and inner ring in their most downward position and the outer ring at its outermost expanded position.

Attention is directed to FIGS. 1, 2 and 8. For the purposes of this discussion the assembled components of blank thumb insert sleeve 60 will be utilize, however it should be recognized that the principles disclosed apply equally to preshaped thumb insert sleeve 70. Fundamental to the design of the present invention is the security and safety of the retention of the finished thumb insert sleeve in a bowling ball hole during bowling activities. It has been determined by testing that the maximum extraction force exerted by a bowling ball user on an installed thumb insert is directly proportional to the gripping strength of the bowling ball user when that individual is using a screwdriver style of tool with a cylindrical handle. The gripping strength therefore is directly proportional to the amount of tightening torque the user is capable of exerting upon cylindrical handle 82 of actuating tool 80 utilized to apply rotational torque to actuating screw 50 of expander device 10. It has been determined for the purposes of the present invention that by combining the clamping force generated by a Unified National Coarse thread form dependently engaging actuating screw 50 with base disc 40, the expanding force of the sliding engagement of inner ring 30 with outer ring 20 with the preferred interface conical taper angle of fifteen degrees, and the aforementioned preferred materials, there can be provided a thumb insert that, when installed by a bowler using a conventional screwdriver style tool, has an extraction force resistance in excess of two times the maximum extraction force that can be applied by that installer to the engaged thumb insert sleeve. This factor of safety is obtained with a coefficient of friction between the thumb insert sleeves and the bowling ball of not less 0.20. Tests of bowling balls made by three ball manufacturers proved that at least that coefficient of friction is attainable by using a polyvinylchoride thumb insert sleeve with a highly polished outside surface in contact with a highly polished wall surface in a drilled hole in a bowling ball made of core materials generally used by those ball manufacturers at the time of this invention.

For the purposes of the following discussion attention is directed to FIG. 9 wherein a thumb insert comprised of preshaped insert sleeve 70 with expander device 10 is shown installed and locked in a drilled hole of a bowling ball. There is disclosed by this illustration a safety feature incorporated in the coon that insures the extraction forces, regardless of their magnitude, imposed on preshaped thumb insert sleeve 70 during its use in a bowling ball cannot cause a failure of any component of expander device 10 that would result in a sudden and uncontrolled release of sleeve 70 from the bowling ball. While expander device 10 is primary in providing the radial contact force required to generate the frictional retention of sleeve 70 in a bowling ball, expander device 10 is functionally fully contained within the counterbore 74 of sleeve 70 and is in no way interposed between the extraction force applied to the thumb insert by the bowler's thumb and the resisting force applied to sleeve 70 by the frictional sliding resistance of the radial contact of portion 75 of sleeve 70 with the inner surface of the bowling ball hole containing said thumb insert. As a result, the maximum operating stresses experienced by expander device 10 are determined entirely by the torque applied by a thumb insert installer to actuator screw 50 of expander device 10 through actuator tool 80 during the installation of sleeve 70 into a bowling ball. While the aforementioned preshaped thumb insert sleeve 70 has been utilized for the purposes of this discussion it must be realized that any thumb insert of the configuration of the current invention would enjoy the same safety benefit.

DESCRIPTION OF INSTALLATION

Figure 7:
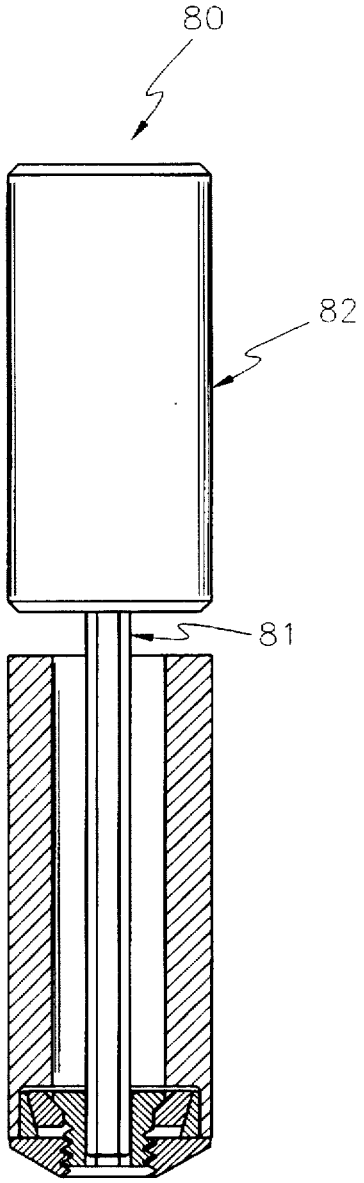
FIG. 7 is a vertical cross-sectional view of a thumb insert assembly, comprised of the blank thumb insert sleeve shown in FIG. 5 and the expander device shown in FIG. 1, with the expander device in an unexpanded condition and showing the preferred hexagonal actuating tool for locking and releasing the thumb insert in a bowling ball hole, positioned within the thumb insert as required to operate the expander device element of the thumb insert.

Attention is directed to FIGS. 7 and 8 for the purposes of the installation and operation procedures presented in the following discussions.

In the initial installation of a one and one-quarter inch diameter thumb insert blank sleeve 60 in an undrilled bowling ball, the items required consist of an expander device 10, an actuating tool 80 or the commercially available equivalent of that tool, one or more one and one-quarter inches diameter blank thumb insert sleeve(s) 60, a one and one-quarter inches diameter standard 118° tip straight twist drill, a standard straight twist drill of a diameter equal to the ball user's selected thumb hole size for each thumb insert desired, a bowling ball drilling machine and thumb insert finishing tools of the design normally possessed by bowling ball merchants. The location and orientation of the bowling ball finger holes and thumb insert hole are performed in accordance with standard procedures for the positioning of bowling ball gripping holes and therefore not described here. Once a thumb hole location and orientation are established, a one and one-quarter inches diameter hole, generally indicated as 90, is drilled in the bowling ball to a maximum depth, as measured from the point of contact between the outer edge of the drill tip and the highest adjoining surface of the bowling ball, of one thirty-second of one inch less than the overall length of thumb insert blank sleeve 60. Next, expander device 10, loosely preassembled as illustrated in FIG. 1, is inserted into counterbore 63 of thumb insert blank sleeve 60 and this combined assembly is inserted into the drilled hole in the bowling ball until the frustoconical bottom face 43 of base disc 40 seats against the conical end face of the drilled hole. Expander actuating tool 80 is then inserted through thumb insert blank sleeve throughbore 62 until it is lockingly engaged in hexagonal throughbore 56 of actuating screw 50, as illustrated in FIG. 7, for rotating said screw. Actuating screw 50 is then rotated clockwise to the maximum torque allowed by the gripping strength of the drilling machine operator on the cylindrical handle 82 of actuating tool 80. The resulting downward motion of screw thread 54 of actuating screw 50, dependently engaged with threaded bore 44 in base disc 40, creates a downward motion of inner ring 30 by virtue of the contact of correspondingly downwardly moving frustoconical outer surface 52 of actuating screw 50 acting upon frustroconical inner surface 34 of inner ring 30. The engaged mating frustoconical outer surface 33 of inner ring 30 acts dependably upon frustoconical inner surface 24 of outer ring 20 to expand cylindrical surface 23 of outer ring 20 to first, radially expand the inner counterbore 63, and as a result the corresponding portion 67 of outer cylindrical surface 61 of thumb insert blank sleeve 60, to engage and subsequently secure thumb insert blank sleeve 60 in the drilled ball hole. The actuating tool 80 then is removed and an appropriate diameter drill is utilized to drill a desired thumb hole 68 in thumb insert blank sleeve 60 to the maximum depth required by the bowler, usually no more than two and five-eighths inches, as measured from the point of contact between the outer edge of the drill tip and the highest adjoining surface of the thumb insert blank sleeve 60. Once the aforementioned thumb hole drilling is completed, the top surface of blank thumb insert 60 is shaped to blend with the spherical surface of the bowling ball and the top edge of thumb hole 90 radiused, using the standard procedures for all bowling ball inserts and drilled thumb holes, to suit the user. If the offset of the upper shaped face of the thumb insert is extreme or the drilled hole has, subsequent to drilling, been given a noncircular shape desired by the thumb insert user then, using a sharp pointed tool, a radial line may be inscribed at one location across the intersection of the top outer edge of the thumb insert sleeve and its adjoining bowling ball surface to insure proper alignment of the thumb insert at each instance of its later installation in the bowling ball: With the completion of these steps the bowling ball and its thumb insert are now ready for bowling use by the person for which the thumb insert(s) was prepared.

To drill additional thumb inserts to other selected thumb hole diameters, as would be expected to take full advantage of the interchangeability of the thumb inserts of the present invention, any thumb insert presently installed in the bowling ball is removed by inserting actuating tool 80 into the hexagonal throughbore of actuating screw 50 and rotating said actuating tool counterclockwise to release the said thumb insert's grip in the bowling ball hole, after which said actuating tool is extracted and aforementioned released thumb insert is removed from the bowling ball. Expander device 10 is then removed from the removed thumb insert by inserting a finger into the throughbore of the thumb insert sleeve and pushing the said expander device out of the its receiving counterbore 63 in the thumb insert sleeve of the removed thumb insert. Expander device 10 is then inserted into a corresponding counterbore 63 of another thumb insert blank sleeve 60, and this thumb insert blank sleeve is installed and locked in the drilled bowling ball hole and drilled and shaped as previously described for first thumb insert blank sleeve 60.

Alternatively, it will be recognized by one skilled in the art that a selected preshaped thumb insert sleeve 70 may be similarly installed, either initially upon the drilling of a bowling ball or as an additional alternative thumb insert in a ball already drilled for a prior insert, utilizing the above described procedures but omitting the thumb hole drilling, no longer required by virtue of said preshaped thumb insert sleeve having been manufactured possessing the desired sized and shaped thumb hole.

Similarly, it will be recognized that either aforementioned style of thumb insert sleeve may be installed in a bowling ball that has been previously fitted with a permanent type thumb insert by extracting or drilling out said permanent insert, by methods already utilized by bowling ball merchants for the ultimate replacement of damaged inserts, and replacing said permanent thumb insert with either a blank thumb insert 60 or preshaped thumb insert 70 using the previously described alternative installation steps for each configuration of said thumb inserts. The previous permanent thumb insert must have originally been installed utilizing one of the three primary thumb insert hole diameters described above as being standard for permanent type thumb inserts, otherwise, it will be necessary to make a special size insert.

DESCRIPTION OF OPERATION

Once a bowling ball has been properly drilled as previously described it is then possible for a bowler possessing an expander device 10, an actuating tool 80 and a set of presized thumb insert sleeves 70 and/or drilled and shaped thumb inserts 60 to quickly install any selected thumb insert sleeve from that set or, alternatively, quickly remove one such already installed thumb insert sleeve and replace it with another thumb insert sleeve from the said set.

Installation of either aforementioned thumb insert sleeve is accomplished by inserting an expander device 10 into the counterbore 63 of said thumb insert sleeve, sliding the thumb insert sleeve into the thumb insert hole in the bowling ball, inserting actuating tool 80 into the hexagonal throughbore of actuating screw 50 as illustrated in FIG. 7, rotating said actuating tool in a clockwise direction to the maximum amount permitted by the strength of the grip of the thumb insert user's hand upon the handle of the said actuating tool and removing said actuating tool from the installed thumb insert.

The replacement of one previously installed thumb insert from the aforementioned set with another thumb insert from the said set is accomplished by first inserting the aforementioned expander device actuating tool 80 into the previously installed driving throughbore of actuating screw 50 as illustrated in FIG. 7, rotating said tool counterclockwise to the extent that said installed thumb insert is free to move in the bowling ball hole, removing aforementioned actuating tool and then pulling said thumb insert from the bowling ball hole. The insertion and locking of the replacement thumb insert is subsequently performed by removing expander device 10 from the bottom counterbore of the removed thumb insert and sequentially installing said expander device and thumb insert as previously described in the immediately preceding paragraph. The final installed thumb insert being illustrated in FIGS. 8 and 9 for a drilled to size blank thumb insert and a pre-shaped thumb insert, respectively.

The invention has been described in terms of a thumb insert, but it will be apparent to those skilled in the art that the invention may also be used for inserts for the finger holes of a bowling ball, and such use is therefore within the scope of the invention. While two specific embodiments of improved bowling ball thumb inserts have been disclosed in the foregoing descriptions, it will be understood that various modifications within the scope of the invention may occur to those skilled in the art. Therefore, the scope of the invention extends to all such adaptations and modifications of the described embodiments as are within the scope of the following claims, and equivalents thereof.

What is claimed is:

1. A bowling ball having a removable insert frictionally retained within a hole in the ball, said insert comprising:

a sleeve having a free sliding fit with the hole when the sleeve is in its relaxed condition, a circumferential resilient tubular wall at a distal end of the sleeve, and an expander within the tubular wall, said expander comprising (a) an inner ring having a cylindrical throughbore and a frustoconical circumference, (b) an outer ring surrounding said inner ring and having a radial slot and a frustoconical bore engaging the circumference of the inner ring, (c) said inner and outer rings being concentric and mated such that downward motion of said inner ring relative to said outer ring acts to expand the diameter of said outer ring into engagement with substantially the entire inner circumference of said tubular wall to expand said tubular wall into frictional engagement with the wall of the hole;

(d) a base disc in the bottom of the hole, said base disc having a central threaded bore, and (e) a center screw threadedly engaged with the base disc.

2. A removable thumb insert for frictional retention within a hole in a bowling ball, said thumb insert comprising:

sleeve, a counterbore formed by a circumferential resilient tubular wall at one end of the sleeve, an expander in the counterbore said expander comprising a radially expansible ring engageable with substantially the entire circumference of said tubular wall, and means for biasing said expansible ring radially outwardly into engagement with said tubular wall to expand said tubular wall radially outwardly, said means comprising an inner solid ring possessing a cylindrical throughbore with a frustroconical countersink in the upper portion of said throughbore and a frustroconical outer face engageable with said radially expansible ring;

said radially expansible ring being radially slotted and having a frustroconical bore engageable with the circumference of said inner ring;

said rings being concentric and engageable with each other such that upon downward motion of said inner ring relative to said expansible ring the diameter of said expansible ring is increased;

a base disc having a central bored hole, and a center screw threadedly engaged with the base disc and said inner ring, operable to longitudinally displace said inner ring relative to said expansible ring.

3. A removable finger insert as defined by claim 2 wherein the insert sleeve includes at least one longitudinal slot through the tubular wall to provide additional radial flexibility.

* * * * *